United States Patent [19]

Azuma

[11] 4,321,886

[45] Mar. 30, 1982

[54] APPARATUS FOR CONTROLLING TONER CONCENTRATION

[75] Inventor: Takashi Azuma, Ebina, Japan

[73] Assignee: Tokyo Shibaura Denki Kabushiki Kaisha, Kawasaki, Japan

[21] Appl. No.: 177,431

[22] Filed: Aug. 12, 1980

[30] Foreign Application Priority Data

Sep. 19, 1979 [JP] Japan ..... 54-120254

[51] Int. Cl.[3] ..... G03G 15/09

[52] U.S. Cl. ..... 118/689; 355/3 DD

[58] Field of Search ..... 118/689, 690; 324/78 Q, 324/236; 355/3 DD

[56] References Cited

U.S. PATENT DOCUMENTS

| | | | |
|---|---|---|---|
| 3,527,651 | 9/1970 | Shelffo et al. | 427/8 |
| 3,698,926 | 10/1972 | Furuichi | 118/689 X |
| 3,707,134 | 12/1972 | Gawron | 118/689 |
| 3,970,036 | 7/1976 | Baer et al. | 118/688 |
| 4,088,092 | 5/1978 | Noguchi | 118/689 |

*Primary Examiner*—Evan K. Lawrence

*Attorney, Agent, or Firm*—Schuyler, Banner, Birch, McKie & Beckett

[57] ABSTRACT

An apparatus for controlling toner concentration utilizing a hollow body upon which a detecting coil is wound. The hollow body responses to the inductance of the developer passing through. The apparatus further comprises: a first digital oscillator with the frequency thereof being variable according to changes in the inductance, a second digital oscillator producing a reference signal at predetermined frequency, and a first and second digital frequency dividers for dividing the outputs of the first and second oscillators, respectively. The fist and second dividers are cleared by the divided output of the other divider. A toner supply mechanism is energized when the first frequency divider is cleared and is de-energized when the second frequency divider is cleared.

4 Claims, 5 Drawing Figures

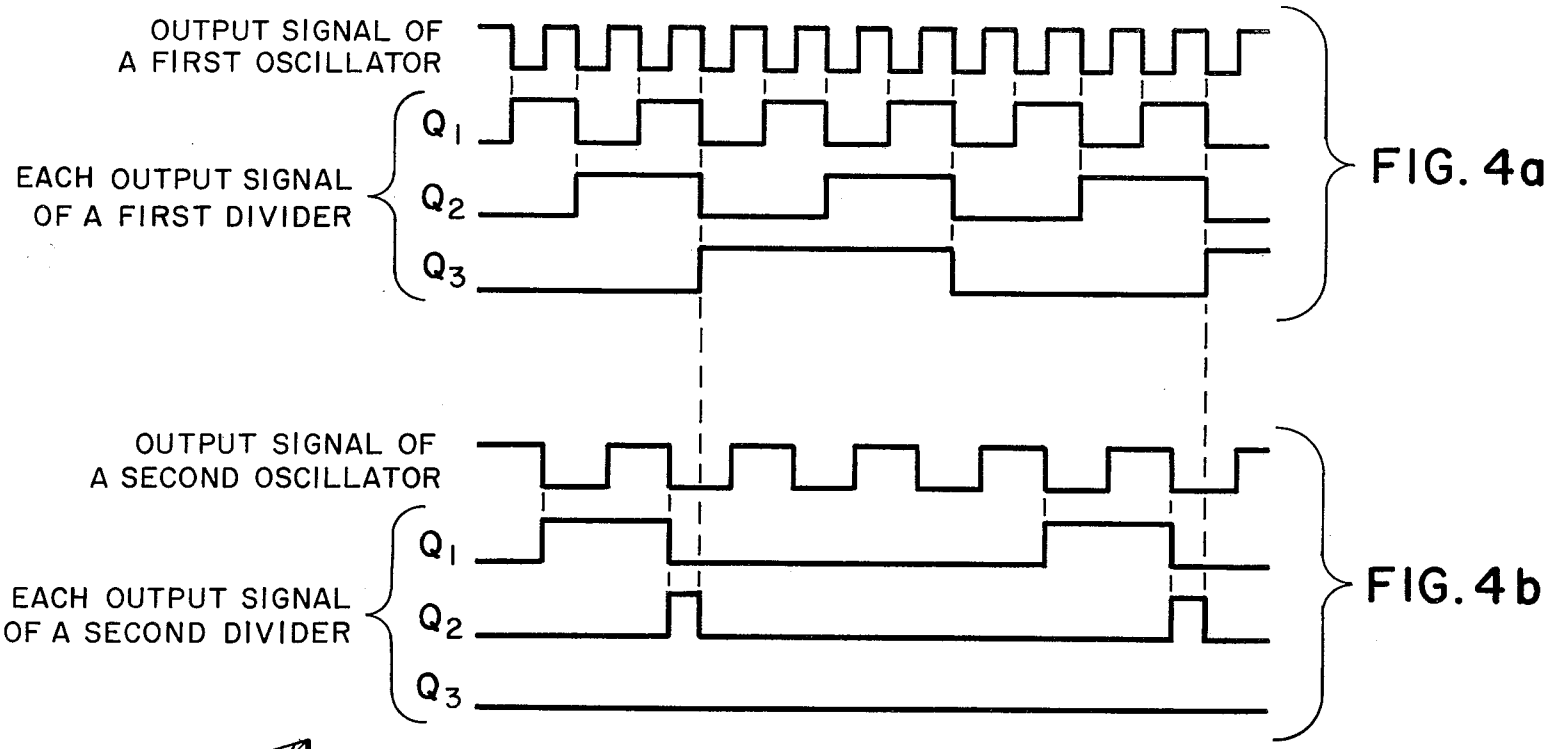
FIG. 4a
FIG. 4b
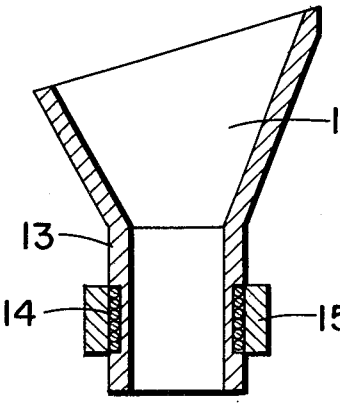
FIG. 2

APPARATUS FOR CONTROLLING TONER CONCENTRATION

BACKGROUND OF THE INVENTION

This invention relates to an apparatus for controlling the toner concentration of developer in an electrostatic printing or copying machine.

The latent electrostatic images formed on the drum of a electrophotographic machine are developed by applying a developer consisting of toner and a magnetic carrier. The toner adheres to the latent image whereas the carrier does not so that after repeated use of the developer, the percentage content of the toner is reduced. As a result, it is necessary to supplement the toner so as to maintain its percentage content to obtain accurate copying at a constant image density. This can be done by monitoring the toner concentration within an optimum range. In the prior art, some systems periodically add toner to the developer by utilizing a toner replenishment device. Such systems, however provides constant quantity of toner irrespective of the nature of the documents that have been copied. That is, copying of documents containing substantial black portions require a greater quantity of toner than copying of documents having a lesser amount of black portions. This prior art system, therefore, fails to maintain constant image density under a wide variety of document conditions.

Further, U.S. Pat. No. 3,970,036 (Baer et al., July 20, 1976) discloses a toner concentration detecting and toner replenishing apparatus for use in an electrostatic copying machine. This apparatus comprising a hollow body, a detecting coil wound on the hollow body, and a means for measuring changes in the inductance of the detecting coil. The measuring means includes an oscillator having a tuned circuit which includes the detecting coil as part of the tuned circuit, and circuitry for detecting a change in the frequency of the oscillator. Finally, means are provided which responds to the measuring means for supplying additional toner from a toner supply chamber. Thus prior art apparatus has relatively complicated and costly analog circuitry including a timing circuit, a sensing oscillator, a reference oscillator, a limiter circuit, a detector circuit, a buffer circuit, and various amplifier and transistor stages.

SUMMARY OF THE INVENTION

It is an object of the present invention to provide an apparatus for controlling toner concentration capable of supplying the toner to the developer quickly and accurately without utilizing complex and costly circuitry.

It is a further object of the present invention to provide an apparatus for controlling toner concentration while maintaining the concentration at an optimum value.

It is still a object of the present invention to provide a highly reliable apparatus for controlling toner concentration.

The present invention is directed to an apparatus for controlling toner concentration utilizing a hollow body upon which a detecting coil is wound. A change in the inductance of the developer passing the detecting coil due to a change in toner concentration is supplied to a first digital oscillator. The frequency of the first oscillator is made variable according to changes in the inductance of the coil. A second digital oscillator is utilized for producing a reference signal at a predetermined frequency. A first and a second frequency dividers are coupled to the respective outputs of the first and second oscillators. The output of each divider is coupled to the input of the other divider so that each divider is cleared by the output of the other divider. The outputs of the dividers are supplied to a flip-flop circuit which feeds a drive circuit. The drive circuit controls a solenoid which adds additional toner to the developer according to the output of the first and second frequency dividers.

BRIEF DESCRIPTION OF THE DRAWINGS

FIG. 2 is a sectional view showing the hollow body of the invention containing a toner detecting coil;

FIG. 4 is a timing charts illustrating the operation of the circuitry of FIG. 3.

DETAILED DESCRIPTION OF THE PREFERRED EMBODIMENTS

Figure 1:
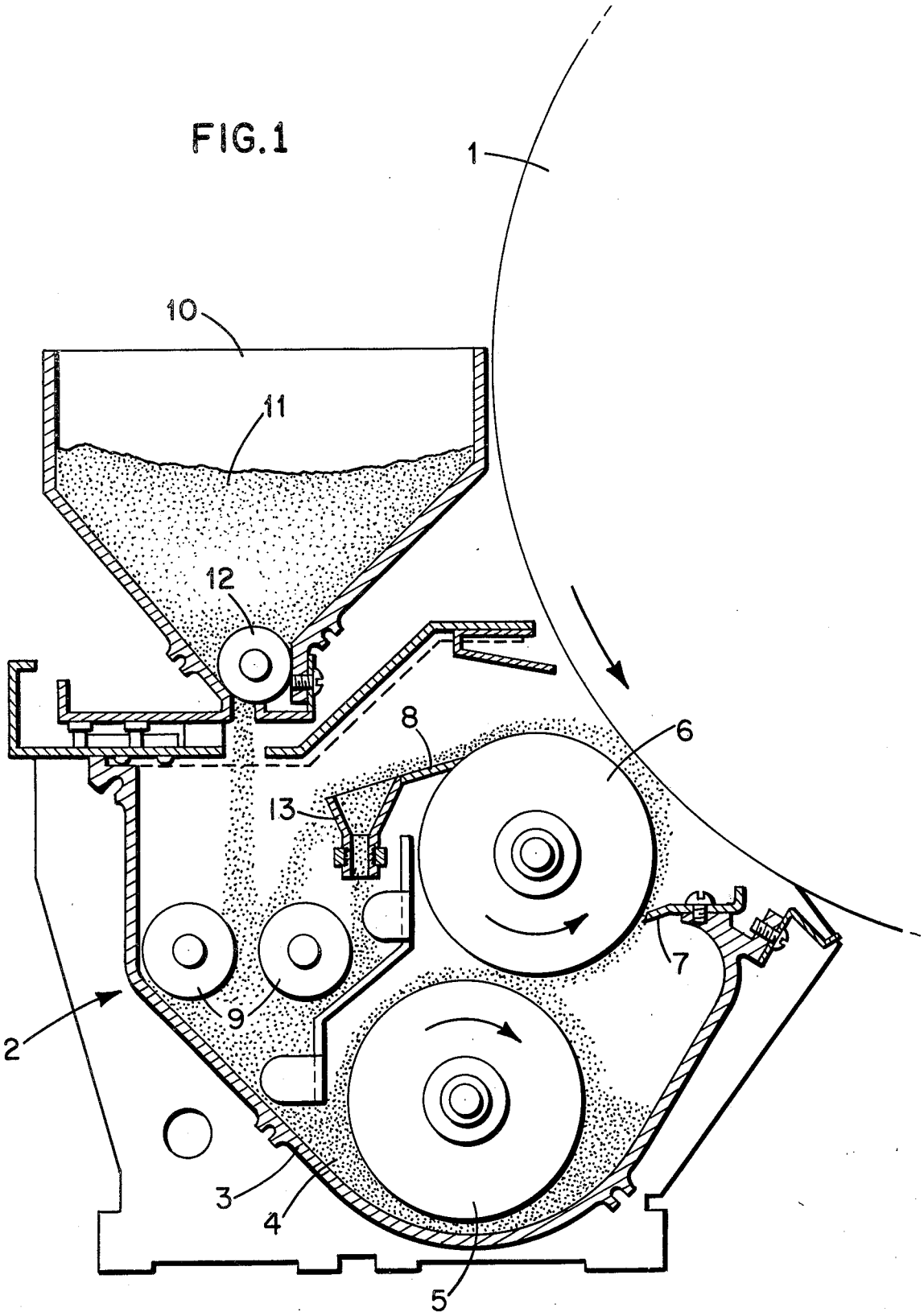
FIG. 1 is a sectional view showing an embodiment of the invention positioned within a developing device.

Referring now to FIGS. 1–4, an explanation will be given regarding a preferred embodiment of the invention. As shown in FIG. 1, the electrostatic copying machine of the invention comprises a photoconductive drum 1, a hopper 10 contained toner 11, a developing device 2 having a developing roller 6 and a hollow body 13. Photoconductive drum 1 is linked to an appropriate drive means (not shown) to rotate in the direction indicated.

Figure 3:
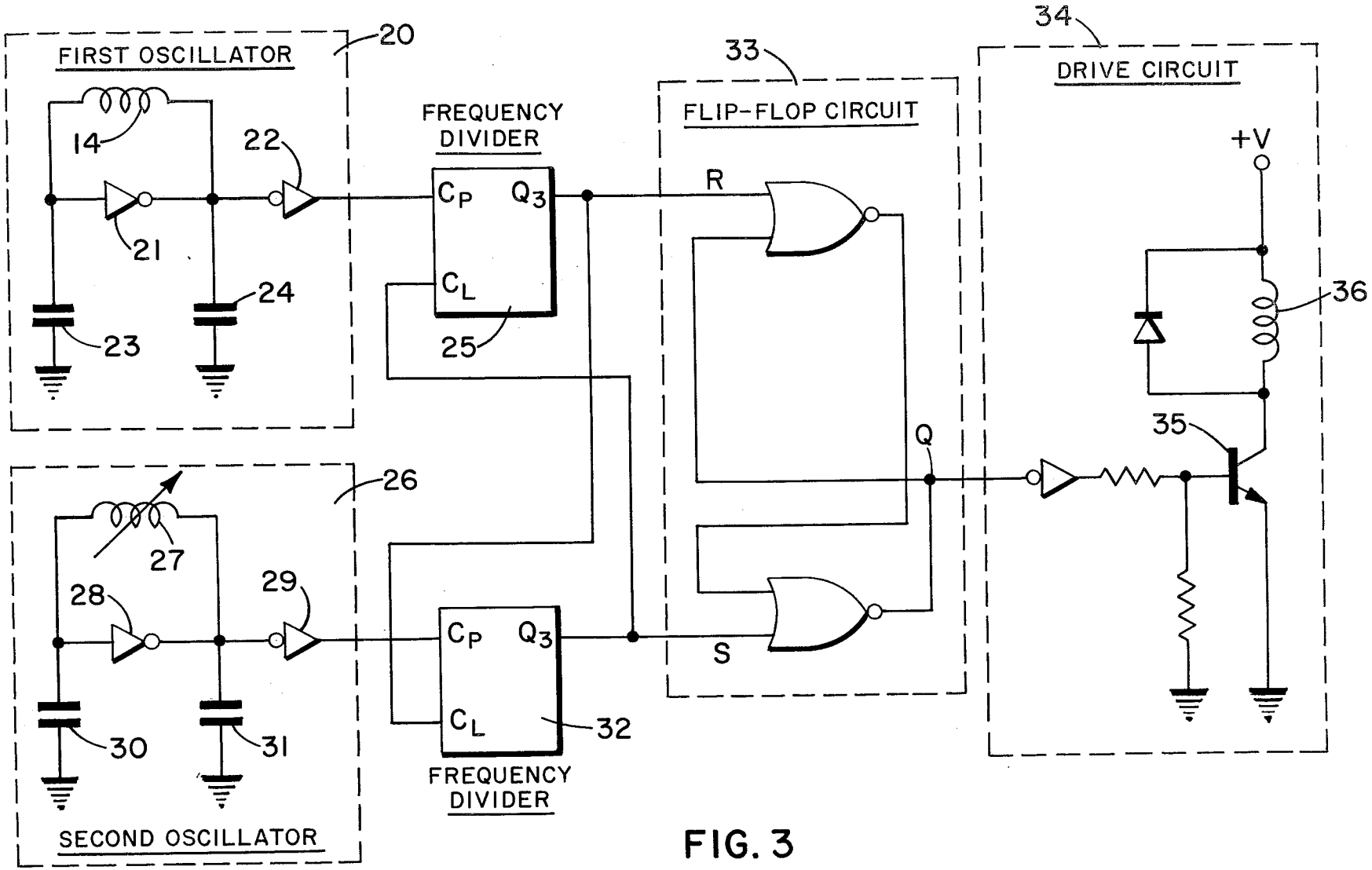
FIG. 3 is a circuit diagram showing an electric circuit of the invention to which the detecting coil is connected.

Developing device 2 includes a casing 3 which contains a developer 4 comprising a mixture of magnetic carrier and toner. A developing roller 6 is rotatably disposed adjacent drum 1 for applying developer to drum 1 which forms latent electrostatic images. Developing roller 6 consists of a well known nonmagnetic rotary sleeve and a stationary magnet fixed in the sleeve. Disposed below developing roller 6 is a transfer roller 5 for transporting the developer to developing roller 6 from the bottom portion of casing 3. Likewise, transfer roller 5 consists of a well known nonmagnetic rotary sleeve and a stationary magnet fixed in the sleeve. A leveler 7 is disposed adjacent developing roller 6 for regulating the thickness of the developer which adheres to developing roller 6. A scraper 8 is provided closely adjacent developing roller 6 for scraping any developer which has adhered to developing roller 6. Scraper 8 directs the adhered developer through a hollow body 13 and onto the bottom portion of casing 3. Positioned between scraper 8 and transfer roller 5, are a pair of agitators (e.g., screw rollers), for agitating the developer, transported from developing roller 6, with toner freshly supplied from a toner supply hopper 10. Hopper 10 includes at its bottom portion a supply roller 12 which is rotatably linked to a drive means through a solenoid 36 (FIG. 3). Upon activation of solenoid 36, as discussed below, toner will be supplied to developing device 2.

Hollow body 13 is vertically positioned adjacent scraper 8. As shown in FIG. 2, hollow body 13 contains an upper integral guide cylinder 13*a* which is flared outwardly. The developer scraped by scraper 8 is guided through guide cylinder 13*a* and into hollow body 13. A detecting coil 14, including a surrounding core 15, is wound on hollow body 13. Detecting coil 14 is actually embedded in the peripheral wall of hollow body 13 so that the developer may pass as close as possible to detecting coil 14 in order to achieve accurate detection. The inductance of coil 14 varies according to the toner concentration of the developer passing through hollow body 13. That is, when the ratio of toner to carrier in the developer is reduced, the magnetic permeability is increased; the inductance is thereby increased. Conversely, when the ratio of toner-to-carrier is increased, the magnetic permeability is reduced; the inductance is thereby reduced. Core 15 is provided for increasing the Q-value of detecting coil 14; as a result, the sensitivity of detecting coil 14 will improve.

FIG. 3 shows an electric circuit comprising a first oscillator 20 having detecting coil 14, inverters 21, 22 and capacitors 23, 24. Inverter 21 is connected in parallel with detecting coil 14. Capacitor 23 is connected between the input terminal of inverter 21 and ground, while capacitor 24 is connected between the output terminal of inverter 21 and ground. The output terminal of inverter 21 is connected to the input terminal of inverter 22. In operation, the oscillation frequency of oscillator 20 changes according to changes in the inductance of detecting coil 14. As a result, the oscillation frequency of oscillator 20 is reduced when the inductance of detecting coil 14 is increased, its oscillation frequency is increased when the inductance of the detecting coil 14 is decreased. The output of first oscillator 20 is supplied to clock pulse input terminal $C_p$ of a frequency divider 25. First divider 25 divides the signal from oscillator 20 by using a three-stage binary counter (not shown) and is cleared according to a frequency divison signal coupled from a second divider 32. The outputs of each stage of the binary counter ($Q_1$, $Q_2$, $Q_3$) are shown in FIG. 4*a*. The frequency division output signal from each divider is $Q_3$ as shown in FIG. 3. Upon clearing first frequency divider 25, all of its three counter stages are thereby reset to produce a low level signal at its output $Q_3$.

A second oscillator 26, similar to oscillator 20, produces a reference signal at a predetermined frequency. Oscillator 26 comprises a variable inductor 27, inverters 28, 29 and capacitors 30, 31. Inverter 28 is connected in parallel with variable inductor 27. Capacitor 30 is connected between the input terminal of inventor 28 and ground, while capacitor 31 is connected between the output terminal of inverter 21 and ground. The output terminal of inverter 28 is connected to the input terminal of inverter 29. The inductance of variable coil 27 is adjusted so that the oscillation frequency of the second oscillator corresponds to the oscillation frequency of first oscillator 20 at an optimum toner concentration detected by coil 14.

The output of second oscillator 26 is coupled to a clock pulse input terminal $C_P$ of a second frequency divider 32, and the output of first divider 25 is coupled to a clear terminal $C_L$ of second divider 32. Second divider 32 divides the signal from second oscillator 26 by using a three stage binary counter (not shown) and is cleared according to a frequency division signal coupled from first divider 25. The outputs of each stage of the binary counter ($Q_1$, $Q_2$, $Q_3$) are shown in FIG. 4(*b*). Upon clearing second frequency divider 32, all of its three counter stages are thereby reset to produce a low level signal at its output $Q_3$. The output of second divider 32 is coupled to a clear terminal $C_L$ of first divider 25 and is also coupled to a set input terminal S of a flip-flop circuit 33 (hereinafter referred to as FF circuit). FF Circuit 33 also receives the output of first divider 25 which is coupled to its reset input terminal R. The set output of FF circuit 33 is coupled to an input terminal of a drive circuit 34. Drive circuit 34 operates according to the output of FF circuit 33 to activate solenoid 36. When solenoid 36 is activated, it couples supply roller 12 to its drive means, as previously discussed.

The operation of the electrostatic copying machine of the above construction will now be described. When no developer passes through hollow body 13, the inductance of coil 14 is low so that the oscillation frequency of first oscillator 20 is higher than the oscillation frequency of second oscillator 26. As shown in FIGS. 4(*a*) and (*b*), the frequency division output signal from first divider 25 (i.e. output stage $Q_3$) is produced before the frequency division output signal from second divider 32 is produced (i.e. output stage $Q_3$); that is no output frequency division signal is produced from second divider 32. As a result, FF circuit 33 remains reset to supply a "low" level signal to NPN transistor 35 of drive circuit 34. Consequently, solenoid 36 is not actuated; as a result, additional toner 11 is not supplied to the developer.

Upon the formation of an electrostatic latent image on photoconductive drum 1, it is rotated, developer is transferred to developing roller 6 by the simultaneous rotation of transfer roller 5 from the bottom portion of casing 3. The developer is attracted to the surface of developing roller 6 and is regulated by leveler 7 to a thickness suitable for developing. The developer on roller 6 then contacts drum 1 to complete the developing of the latent image on drum 1. Any residual developer adhering to developing roller 6 is scraped off by scraper 8 and restored to the bottom portion of casing 3. The developer which has been scraped off developing roller 6 is then guided through guide cylinder 13*a* where it falls through hollow body 13 and past detecting coil 14. When the ratio of toner to carrier is reduced, the inductance of detecting coil 14 will be increased. Consequently, the oscillation frequency of first oscillator 20 will become lower than that of second oscillator 26. This results in the frequency division signal from second divider 32 being produced before the frequency division signal from first divider 25; that is, no frequency division signal will be produced from first divider 25. As a result, FF circuit 33 is set to provide a "high" level signal to transistor 35 thus triggering transistor 35 to energize solenoid 36. Upon energizing solenoid 36, supply roller 12 is coupled to its drive by means (not shown) to supply additional toner from hopper 10 supplied to the developer within casing 3.

When the ratio of toner to carrier is increased, the inductance of detecting coil 14 will be reduced. Consequently, the oscillation frequency of first oscillator 20 will become higher than that of second oscillator 26. This results in the frequency division signal from first divider 25 being produced before the frequency division signal from second divider 32; that is, no output signal is produced from second divider 32. As a result, FF circuit 33 is reset to supply the "low" level signal to transistor 35, thus cutting off transistor 35 to de-energize solenoid 36. Upon de-energizing solenoid 36, supply roller 12 is disconnected from its drive means to prevent further supply of toner 11 to developer 4.

In this way, it is possible to obtain prompt and accurate replenishment of toner 11 according to changes in toner concentration. Further, since core 15 is designed to surround detecting coil 14, the sensitivity and response of detecting coil 14 is increased. As a result, the replenishment of toner 11 occurs even when slight changes in toner concentration is detected.

I claim:

1. In an apparatus for controlling toner concentration of developer, consisting of a mixture of magnetic carrier and toner, to produce an optimum toner concentration comprising: a toner supply hopper, a developer supply chamber, toner supply means for supplying the toner from said hopper to said developer supply chamber, a developer transporting means for transporting the developer from said developer supply chamber and applying it to a photoconductive member to form a visible image; a hollow body having an inlet and outlet, means for carrying said developer from said transporting means to said inlet to cause developer to flow through said hollow body from said inlet to said outlet; a detecting means carried by said hollow body for detecting the inductance of the developer passing through said hollow body, the improvement comprising:

a first digital oscillator coupled to said detecting means having an output frequency which is dependent upon the inductance of the developer sensed by the detectng means;

a second digital oscillator producing an output reference signal having a predetermined frequency corresponding to said optimum toner concentration;

a first frequency divider means for dividing the output frequency of said first digital oscillator and producing a first divider output;

a second frequency divider means for dividing the output frequency of said second digital oscillator and producing a second divider output;

said first frequency divider being cleared by the second divider output, and said second frequency divider being cleared by said first divider output; and a control means responsive to said first divider output and said second divider output for energizing said toner supply means to supply toner to said developer supply chamber when said first frequency divider is cleared, and for de-energizing said toner supply means when said second frequency divider is cleared.

2. The apparatus for controlling toner concentration according to claim 1 wherein said detecting means comprises a core surrounding said hollow body.

3. The apparatus for controlling toner concentration according to claim 1 wherein said control means comprises a flip-flop circuit having a set input and a reset input, said first divider output coupled to the reset input for de-energizing said toner supply means to prevent supply of said toner and said second divider output coupled to the set input for energizing said toner supply means to supply said toner, and said flip-flop circuit having an output terminal coupled to said toner supply means.

4. The apparatus for controlling toner concentration according to claim 2 wherein detecting means further comprises a detecting coil which is embedded in peripheral wall of the hollow body.

* * * * *